US007193592B2

(12) United States Patent
Nakamura

(10) Patent No.: US 7,193,592 B2
(45) Date of Patent: Mar. 20, 2007

(54) DISPLAY DEVICE

(75) Inventor: Norio Nakamura, Kanazawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 439 days.

(21) Appl. No.: 10/705,972

(22) Filed: Nov. 13, 2003

(65) Prior Publication Data

US 2004/0095340 A1 May 20, 2004

(30) Foreign Application Priority Data

Nov. 13, 2002 (JP) ..... 2002-329712

(51) Int. Cl.
*G99G 3/30* (2006.01)

(52) U.S. Cl. ..... 345/84; 345/42; 345/63; 345/68

(58) Field of Classification Search ..... 345/42, 345/61, 63, 67, 68, 76, 84, 87
See application file for complete search history.

(56) References Cited

U.S. PATENT DOCUMENTS 4,812,642 A * 3/1989 Hasegawa et al. ..... 250/221
5,706,020 A * 1/1998 Iwama ..... 345/60
2001/0043113 A1* 11/2001 Hoshino et al. ..... 327/534
2002/0113763 A1* 8/2002 Koyama ..... 345/87
2003/0058199 A1* 3/2003 Kasai ..... 345/76

FOREIGN PATENT DOCUMENTS

KR 1999-0059997 7/1999
KR 2001-0059960 7/2001
KR 10-0296872 10/2001

OTHER PUBLICATIONS

Okada, Hiroshi; Drive Circuit for Light Emitting Element; Pub. No. JP363229791; Pub. Date Sep. 26, 1988.*
Imawaka, Mitsueru; Intermediate Gradation Display Control Unit; Pub. No. JP411352936; Pub. Date Dec. 24, 1999.*
Shibata, Susumu et al.; Liquid Crystal Display Device; Pub. No. JP410319373; Pub. Date Dec. 4, 1998.*

* cited by examiner

*Primary Examiner*—Bipin Shalwala
*Assistant Examiner*—Vincent E. Kovalick
(74) *Attorney, Agent, or Firm*—Oblon, Spivak, McClelland, Maier & Neustadt, P.C.

(57) ABSTRACT

A display device includes self-luminous elements arrayed to form a display screen, and a driving circuit which causes drive currents to flow in the self-luminous elements according to pixel signals. Particularly, the driving circuit is configured to restrict the drive currents flowing in the self-luminous elements upon increase in the total sum of the drive currents.

4 Claims, 4 Drawing Sheets

DISPLAY DEVICE

CROSS-REFERENCE TO RELATED APPLICATIONS

This application is based upon and claims the benefit of priority from the prior Japanese Patent Application No. 2002-329712, filed Nov. 13, 2002, the entire contents of which are incorporated herein by reference.

BACKGROUND OF THE INVENTION

1. Field of the Invention

The present invention relates to a display device having pixels formed of self-luminous elements such as organic electro-luminescent (EL) elements.

2. Description of the Related Art

In recent years, attention has been attracted to flat-panel display devices such as an organic EL display device, and active research and development have been made for use in a personal computer, portable information terminal, and the like. An organic EL display device has an advantageous feature that does not employ a backlight undesired for reduction in thickness and weight, is suited for reproduction of moving images owing to its high-speed response, and is usable in a cold place because a decrease in the luminance is not caused by a low temperature.

Such an organic EL display device generally comprises a matrix array of pixels each having an organic EL element that emits light at luminance corresponding to a current supplied thereto and a driving circuit for driving these pixels. The driving circuit includes a digital-to-analog (D/A) conversion circuit for converting, for example, digital pixel signals into analog pixel signals and a gradation reference circuit for generating a plurality of gradation reference voltages or currents that are referred to by the D/A conversion circuit. In a case where the gradation reference circuit divides, for example, a reference power supply voltage to generate these gradation reference voltages, the D/A conversion circuit selects one of these gradation reference voltages based on the digital pixel data signal and outputs the selected voltage as an analog pixel signal. Each pixel is driven according to the analog pixel signal obtained in this manner.

In this organic EL display device, brightness of a display screen depends on currents flowing in the organic EL elements. In the case where the organic EL elements are set at the maximum luminance to obtain a gradation of white on the entire display screen, a considerable amount of power is consumed according to the total sum of currents flowing in the organic EL elements. Further, such power consumption requires a power supply circuit that has a current supply capacity suitable for the currents flowing in the organic EL elements, thus leading to an increase in manufacturing costs and outer dimensions of the power supply circuit.

These problems should be remedied for organic EL display devices to be incorporated in equipment where the manufacturing cost, power consumption, volume, or the like is restricted. Conventionally, the luminance for the white gradation has been restricted to reduce currents flowing in the organic EL elements. However, this gives the impression that a white display portion is darkish when the area of the white display portion becomes small in the entire display screen.

BRIEF SUMMARY OF THE INVENTION

It is an object of the present invention to provide a display device that can reduce power consumed for displaying an image in high gradations. It is another object of the present invention to provide a display device that can mitigate the load imposed on a power supply circuit.

According to the present invention, there is provided a display device which comprises a plurality of self-luminous elements arrayed to form a display screen, and a driving circuit which causes drive currents to flow in the self-luminous elements according to pixel signals, the driving circuit being configured to restrict the drive currents flowing in the self-luminous elements upon increase in the total sum of the drive currents.

In this display device, the driving circuit restricts the drive currents flowing in the self-luminous elements upon increase in the total sum of the drive currents. The total sum of the drive currents considerably increases when the area of a white display portion becomes large in the entire display screen. At this time, the drive currents are restricted. Thus, luminance is uniformly decreased in each of the self-luminous elements, so that the load imposed on a power supply circuit can be mitigated. Accordingly, an increase in the manufacturing cost and outer dimensions of the power supply circuit is avoidable. On the other hand, when the area of the white display portion becomes small in the entire display screen, the currents flowing in the self-luminous elements are not restricted to the same degree as that in the case where the white display portion occupies the entire display screen. Thus, it is possible to avoid the impression that the white display portion is darkish. For these reasons, the present display device can mitigate the load imposed on the power supply circuit without giving the feeling that something is wrong with brightness that depends on the area ratio of the white display portion to the entire display screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

An organic EL display device according to one embodiment of the present invention will be described with reference to the accompanying drawings.

Figure 1:
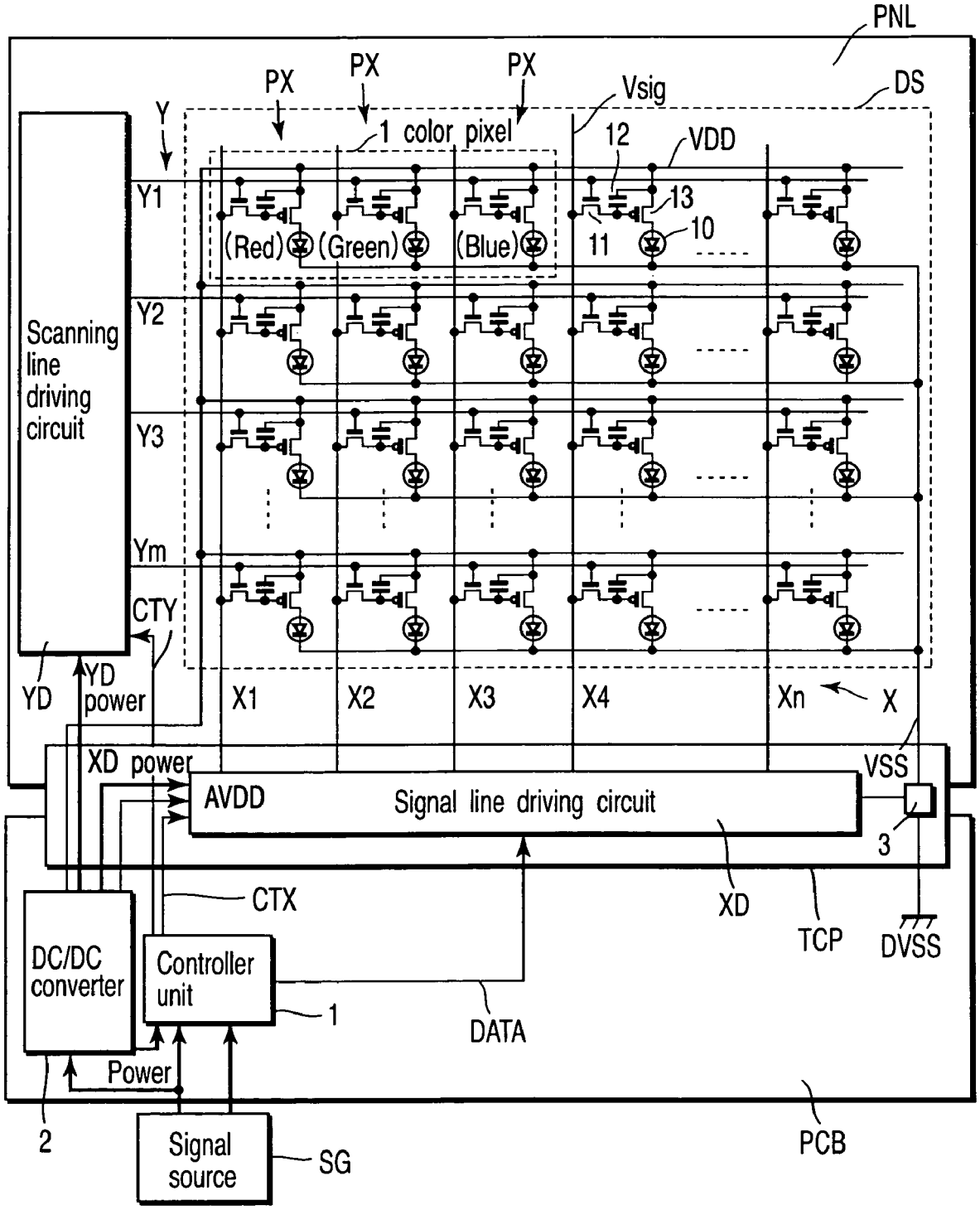
FIG. 1 is a diagram schematically showing a circuit configuration of an organic EL display device according one embodiment of the present invention.
Figure 2:
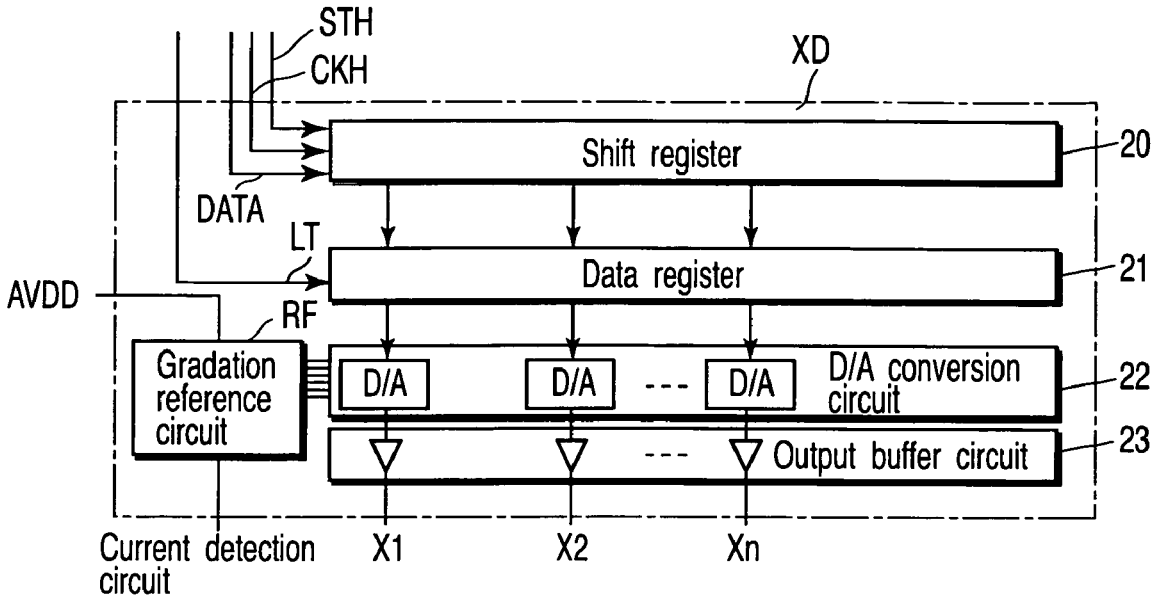
FIG. 2 is a diagram showing a configuration of a signal line driving circuit shown in FIG. 1.
Figure 3:
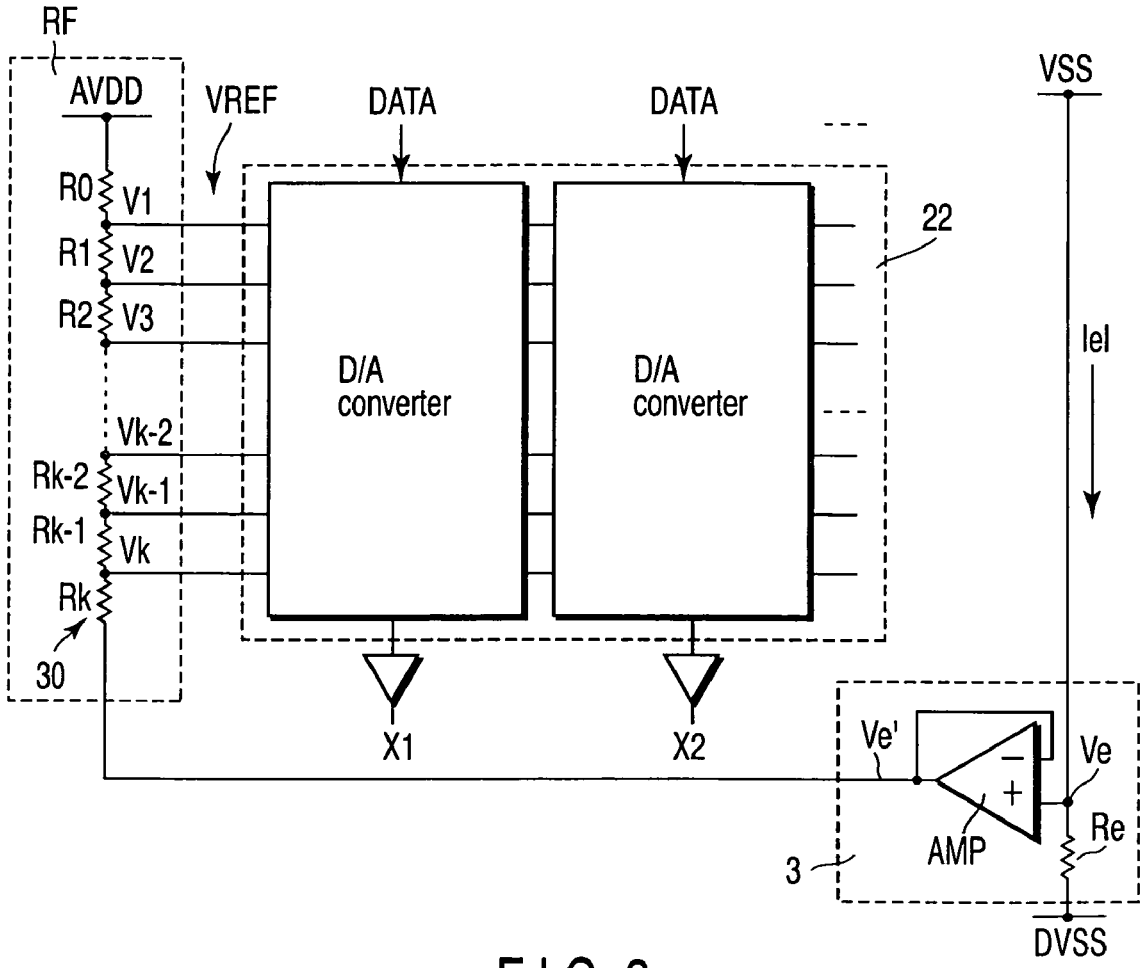
FIG. 3 is a diagram showing a reference circuit and a current detection circuit that are shown in FIG. 1.

FIG. 1 shows a circuit configuration of the organic EL display device. FIG. 2 shows a configuration of a signal line driving circuit shown in FIG. 1. FIG. 3 shows a gradation reference circuit and a current detection circuit that are shown in FIG. 1. This organic EL display device comprises an organic EL panel PNL, an external circuit board PCB, and a tape carrier package TCP connected between the organic EL panel PNL and the external circuit board PCB.

The organic EL panel PNL includes a plurality of pixels PX which are arrayed in matrix on, for example, a glass substrate to form a display screen DS, m number of scanning lines Y (Y1–Ym) which are disposed along rows of the pixels PX, n number of signal lines X (X–Xn) which are substantially perpendicular to the scanning lines Y, and a scanning line driving circuit YD for driving the scanning lines Y1–Ym. The adjacent three pixels PX arranged in the row direction serve as one color pixel, and emit light in red (R), green (G), and blue (B), respectively. Each of the pixels PX includes an organic EL element 10 which is a self-luminous element for emitting light in one emission color selected from the R, G, and B, a pixel switch 11 which is controlled by a corresponding scanning line Y to capture an analog pixel signal Vsig on a corresponding signal line X, a capacitance element 12 for holding the pixel signal Vsig supplied from the pixel switch 11, and a current-driving element 13 which is controlled by the pixel signal Vsig held in the capacitance element 12 to supply a drive current DIDD to the organic EL element 10. The pixel switch 11 is formed of an N-channel polysilicon thin film transistor, for example. The current-driving element 13 is formed of a P-channel polysilicon thin film transistor, for example. The organic EL element 10 is connected in series with the current-driving element 13 between power lines VDD and VSS.

Specifically, the organic EL element 10 is connected at its cathode to the power line VSS and at its anode to a drain of the thin film transistor for the current-driving element 13. This thin film transistor for the current-driving element 13 is connected at its gate to a drain of the thin film transistor for the pixel switch 11 and at its source electrode to the power line VDD. The thin film transistor for the pixel switch 11 is connected at its source electrode to the signal line X and at its gate electrode to the scanning line Y. The capacitance element 12 is formed of the power line VDD and a wiring line which overlaps with the power line VDD and interconnects the gate of the thin film transistor for the current-driving element 13 and the drain of the drain of the thin film transistor for the pixel switch 11. In addition, the scanning line driving circuit YD is formed by combining a plurality of P- and N-channel polysilicon thin film transistors that are formed in the same process as that for the thin film transistors included in the pixels PX.

The external circuit board PCB includes a controller unit 1 formed an IC chip for receiving pixel data signals DATA output in a digital format from a signal source SG such as a personal computer, generating kinds of control signals for driving the organic EL panel PNL and also performing a digital processing of changing the arrangement of the pixel data signals DATA and a DC/DC converter 2 for converting a power supply voltage supplied from an outside into regulated internal power supply voltages of various levels. The controller unit 1 generates, for example, a vertical scanning control signal CTY and a horizontal scanning control signal CTX, as the kinds of control signals. The vertical scanning control signal CTY comprises a vertical start signal and a vertical clock signal. The horizontal scanning control signal CTX comprises a horizontal start signal STH, a horizontal clock signal CKH, and a latch signal LT. The vertical scanning control signal CTY is supplied from the controller unit 1 to the scanning line driving circuit YD, while the horizontal scanning control signal CTX and the pixel data signals DATA are supplied from the controller unit 1 to the signal line driving circuit XD.

Further, the external circuit board PCB is connected via the tape carrier package unit TCP to the organic EL panel PNL. The tape carrier package unit TCP comprises a signal line driving circuit XD and a current detection circuit 3. The signal line driving circuit XD includes a series of tape carrier packages each having a driver IC mounted on a flexible wiring plate to drive the n number of signal lines X1, X2, X3, . . . , and Xn according to the pixel signals. The current detection circuit 3 is connected between the power line VSS and a power line DVSS.

The scanning line driving circuit YD shifts the vertical start signal in synchronization with the vertical clock signal to sequentially select one of the m number of scanning lines Y and supply a gate drive voltage (scanning signal) to a selected scanning line Y in an effective video period of a horizontal scanning period.

As shown in FIG. 2, the signal line driving circuit XD includes: a shift register 20 which shifts the horizontal start signal STH in synchronization with the horizontal clock signal CKH to serial-to-parallel convert the pixel data signals DATA supplied from the control unit 1; a data register 21 for latching and output the pixel data signals DATA supplied from the shift register 20 under the control of the latch signal LT; a D/A conversion circuit 22 for converting the pixel data signals DATA into analog pixel signals Vsig; a gradation reference circuit RF for generating a predetermined number of gradation reference voltages VREF (V1–Vk) which are referred to by the D/A conversion circuit 22; and an output buffer circuit 23 for performing current-amplification of the analog pixel signals Vsig obtained from the D/A conversion circuit 22, to output the signals to the signal lines X1, X2, X3, . . . , and Xn.

The gradation reference circuit RF, as shown in FIG. 3, has a ladder resistor 30 made up of resistors R0-Rk which are connected in series between a power line AVDD and an output terminal of the current detection circuit 3, and divide a reference power supply voltage applied to the ladder resistor 30 to generate the predetermined number of gradation reference voltages REF (V1–Vk). In FIG. 3, V1 indicates a gradation reference voltage for a minimum gradation and Vk indicates a gradation reference voltage for a maximum gradation.

The D/A conversion circuit 22 includes a plurality of D/A converters (i.e., resistor DACs) each of which selects any one of the predetermined number of gradation reference voltages V1–Vk based on the pixel data signal DATA supplied from the data register 21, and then divides the selected voltage using a series of resistor to output an analog pixel signal Vsig corresponding to the result of division. The output buffer circuit 23 includes a plurality of buffer amplifiers each of which outputs the analog pixel signal Vsig supplied from a corresponding D/A converter to a corresponding signal line X.

Each of the pixels PX operates under a pixel driving power supply voltage applied between the power lines VDD and DVSS from the DC/DC converter 2. During a period when the scanning signal on the scanning line Y is held at a high level, the N-channel thin film transistor of the pixel switch 11 is active, so that the analog pixel signal Vsig on the signal line X is applied to one end side electrode of the capacitance element 12 to charge this capacitance element 12. It is to be noted that a voltage to be finally held at the one end side electrode of the capacitance element 12 equals to that of the analog pixel signal Vsig obtained from the scanning line X immediately before the scanning signal on the scanning line Y has become a low level. The one end side electrode of the capacitance element 12 is further connected to the gate of the P-channel thin film transistor for the current-driving element 13 and the other end side electrode thereof is connected to the source of this P-channel thin film transistor, so that the capacitance element 12 is charged up to a gate-source voltage Vgs of the P-channel thin film transistor. A drain-source current Ids of the P-channel thin film transistor increases and decreases as the gate-source voltage Vgs changes. In this case, since a current identical to the current Ids flows in the organic EL element 10, this current vary with the analog pixel signal Vsig, so that light is emitted at luminance corresponding to the current.

Figure 4:
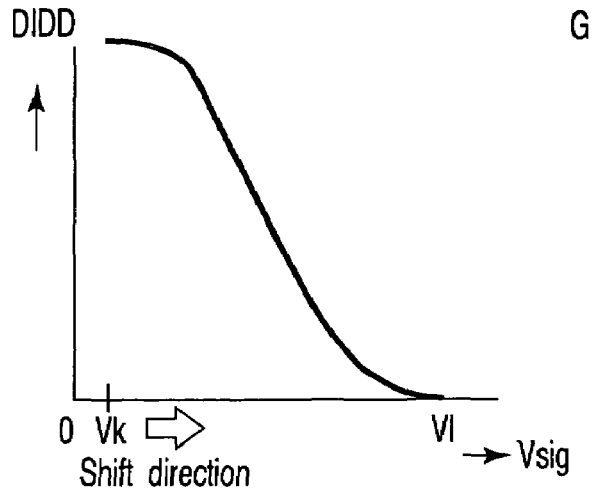
FIG. 4 is a graph showing a relationship between an analog pixel signal which is output to a signal line shown in FIG. 1 and a drive current which flows in an organic EL element.
Figure 5:
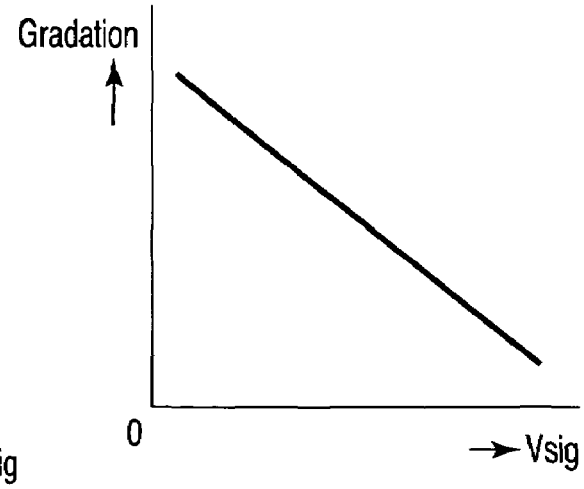
FIG. 5 is a graph showing a relationship between an analog pixel signal which is output to a signal line shown in FIG. 1 and a gradation of the pixel signal.

Since the current-driving element 13 is formed of a P-channel thin film transistor, the drive current DIDD flowing from the power line VDD via the organic EL element 10 to the power line VSS increases as shown in FIG. 4, as the analog pixel signal Vsig decreases. Further, the relationship between the analog pixel signal Vsig and the gradation is shown in FIG. 5. As shown in FIG. 5, the gradation or luminance of the pixel data signal increases as the analog pixel signal Vsig decreases.

The current detection circuit 3 described above includes a resistor Re and an operational amplifier AMP which are connected to detect the total sum Ie1 of the drive currents DIDD flowing from the power line VDD via the plurality of organic EL elements 10 to the power line VSS. A drop voltage Ve across the resistor Re depends on the total sum Ie1 of the drive currents DIDD. As a result, the operational amplifier AMP outputs from its output terminal a follower voltage Ve' substantially equal to the drop voltage Ve.

In this case, the reference power supply voltage applied to the ladder resistor 30 of the gradation reference circuit RF is correctable with a use of the voltage Ve' output from the current detection circuit 3. Specifically, since the gradation reference voltage Vk is kept substantially equal to the output voltage Ve' of the current detection circuit 3, as the voltage Ve' increases by a certain increment upon an increase in the total sum Ie1 of the drive currents DIDD, the voltage Vk also shifts by as much as this increment as indicated by a bold arrow in FIG. 4. Even when the voltage Vk shifts in such a manner, a difference between the voltage Vk and the voltage V1 is divided equally by the ladder resistor 30, so that the relationship between the pixel signal Vsig and the gradation is maintained to be substantially identical to that shown in FIG. 5.

Figure 6:
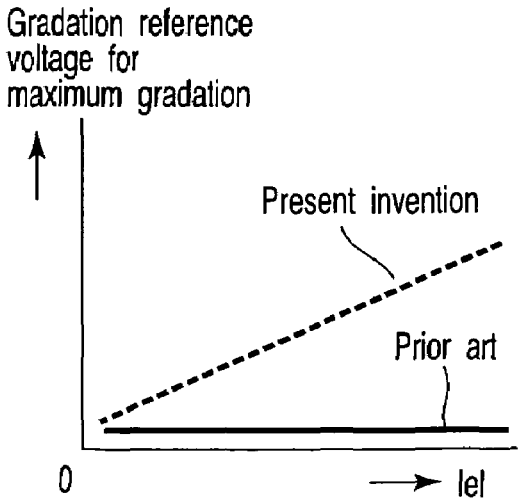
FIG. 6 is a graph showing a relationship between the total sum of drive currents flowing in organic EL elements shown in FIG. 1 and a gradation reference voltage output for a maximum gradation.

In contrast to a case of conventional display devices, in the organic EL display device described above, as shown in FIG. 6, the reference gradation voltage Vk (≈Ve'≈Ve) for the maximum gradation is not constant but increases upon an increase in the total sum Ie1. Further, the increase in the voltage Vk resultantly restricts the total sum Ie1 of the drive currents DIDD which are supplied via the current-driving elements 13 formed of the P-channel thin film transistors, so that the voltage Vk and the total sum Ie1 of the drive currents DIDD are finally kept in an equilibrium state electrically, thus making the total sum Ie1 of the drive currents DIDD constant.

Figure 7:
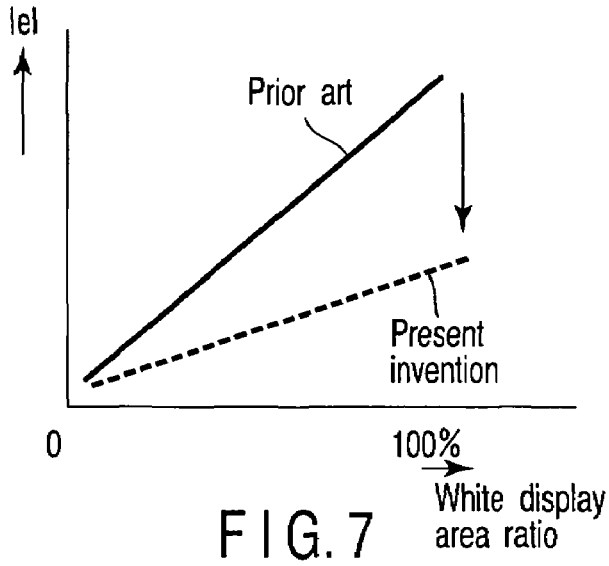
FIG. 7 is a graph showing a relationship between an area ratio of a white display portion to a display screen and the total sum of the drive currents flowing in the organic EL elements.

As shown in FIG. 7, conventionally, the total sum Ie1 increases as an area ratio of the white display portion, for example, increases. In the present invention, the gradation reference voltage Vk for the maximum gradation increases so as to suppress the increase in the total sum Ie1. Therefore, by causing each of the organic EL elements 10 to emit light at high luminance when the area ratio of the white display portion is small and causing each of the organic EL elements 10 to emit light at low luminance when the area ratio of the white display portion is large, it is possible to mitigate the load imposed on the power supply circuit that depends on the total sum Ie1 of the drive currents DIDD consumed by all the organic EL elements 10.

In addition, when a large area is occupied for display at the maximum gradation, that is, when the area ratio of the white display portion is large, any differences observable to viewers are not caused by the low luminance.

With adjustment of luminance according to the total sum of the drive currents DIDD, it is possible to suppress power consumption.

Further, heating of the panel caused by an increase in the total sum of the drive currents DIDD is also mitigated, thus suppressing deterioration of the organic EL elements.

The present invention is not limited to the aforementioned embodiment and various modifications can be made as described below.

Figure 8:
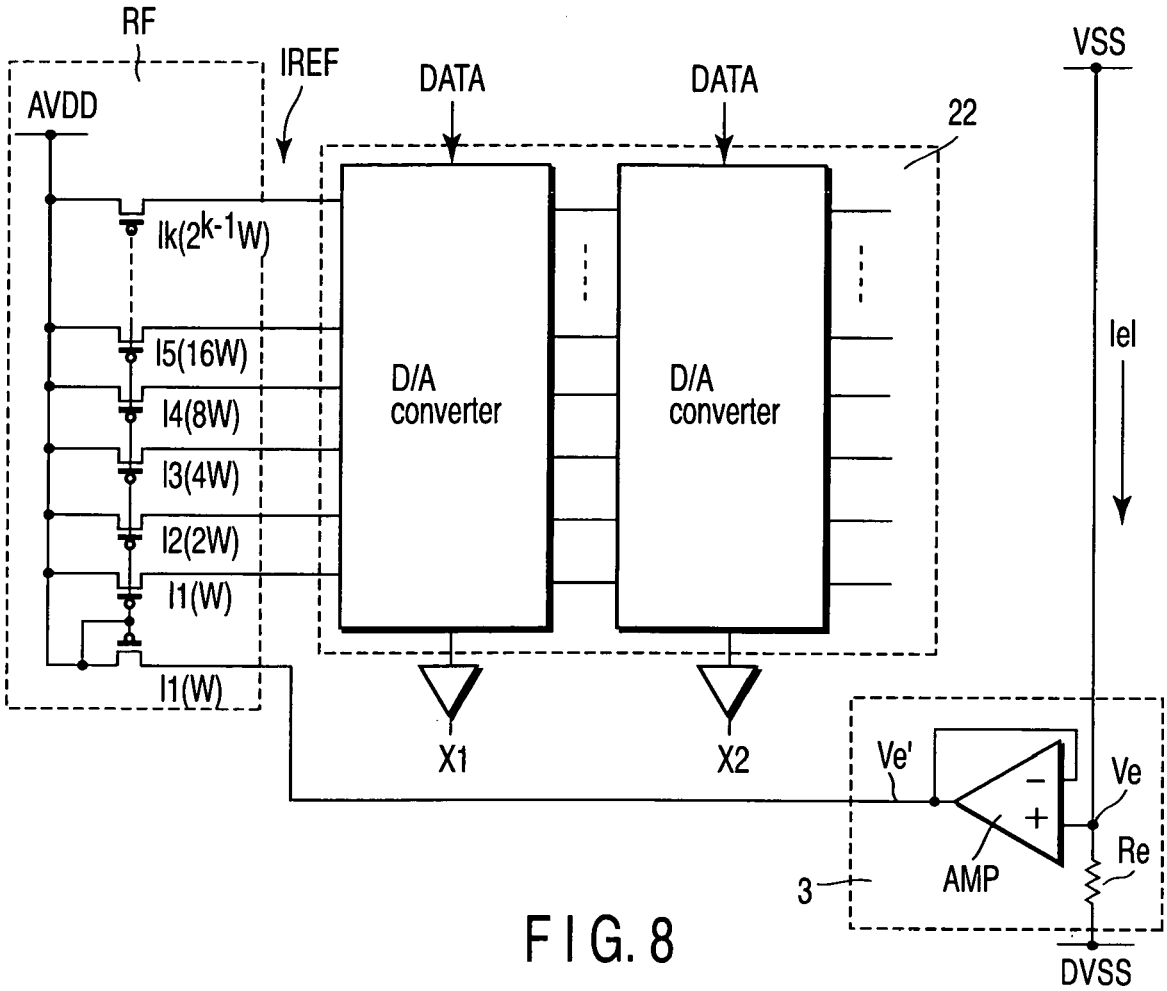
FIG. 8 is a diagram showing a modification in which the gradation reference circuit shown in FIG. 3 is modified for application to a current control type D/A conversion circuit.
Figure 9:
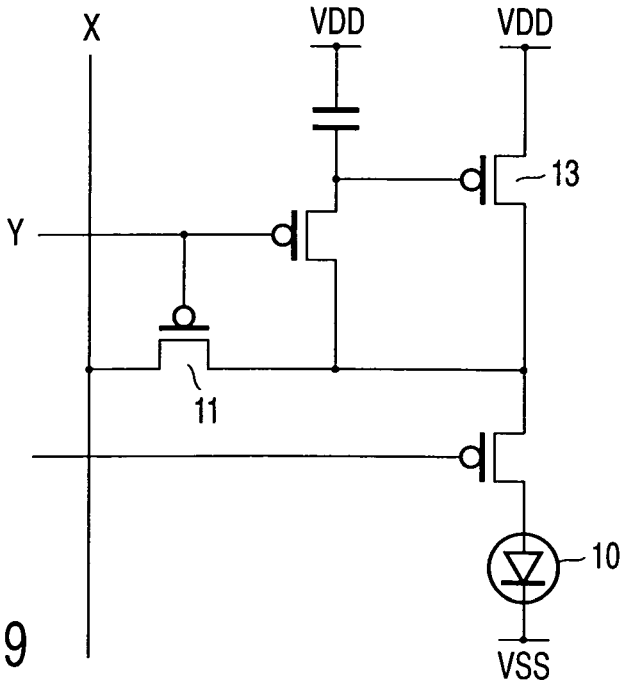
FIG. 9 is a circuit diagram showing a modification of a display element.

Although in the above-mentioned embodiment, each of the pixels is driven by a voltage signal supplied as the pixel signal. The present invention is also applicable to a display device including the pixels each of which is driven by a current signal as shown in FIG. 9. An example of the gradation reference circuit for this display device will be described below. In this display device, the gradation reference circuit RF is associated with the D/A conversion circuit 22 which is formed of a current control type. In contrast to the above-mentioned embodiment where the gradation reference circuit RF has been arranged to generate a predetermined number of gradation reference voltages, the gradation reference circuit RF is arranged, as shown in FIG. 8, to generate a predetermined number of gradation reference currents IREF (I1–Ik) whose current ratios to a reference power supply current are different from each other. That is, the gradation reference circuit RF is formed of a current mirror circuit comprising a plurality of active current mirror elements which are connected to output the predetermined number of gradation reference currents IREF (I1–Ik) as the predetermined number of gradation reference signals. Specifically, (k+1) number of thin film transistors are provided as the active current mirror elements. A first one of the thin film transistors has a current path connected between the power line AVDD and an output terminal of the current detection circuit 3, and a gate connected to its own drain disposed on the side of the power line AVDD. The remaining k thin film transistors have gates commonly connected to the gate of the first thin film transistor and current paths respectively connected to the power line AVDD and k gradation reference current input terminals placed on the side of the D/A conversion circuit 22. Further, the k thin film transistors are set to have, for example, channel widths W, 2W, 4W, 8W, 16W, . . . , $2^{k-1}$W with respect to a channel width W of the first thin film transistor. Accordingly, a current flowing in the first thin film transistor serves as the reference power supply current, and the gradation reference currents I1–Ik whose current ratios to the reference power supply current are different from each other are supplied to the D/A conversion circuit 22.

Even in a case where the gradation reference circuit RF is arranged as described above, it is possible to uniformly correct levels of the gradation reference currents I1–Ik based on the output voltage Ve' of the current detection circuit 3, thereby obtaining almost the same effects as those by the above embodiment.

Further, although in the above embodiment the single gradation reference circuit RF has been used commonly to all the D/A converters of the D/A conversion circuits 22, if considerable differences exist in the light emission properties of the self-luminous elements (e.g., organic EL elements) due to emission colors such as red, green and blue, a plurality of gradation reference circuits may be provided for different kinds of the light emitting properties, along with the above-mentioned current detection circuits 3 connected thereto.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A display device comprising:

a plurality of self-luminous elements arrayed to form a display screen; and a driving circuit which causes drive currents to flow in said self-luminous elements according to pixel signals, said driving circuit being configured to restrict the drive currents flowing in said self-luminous elements upon increase in the total sum of the drive currents, wherein said driving circuit comprises, a D/A conversion circuit which digital-to-analog converts the pixel signals;

a gradation reference circuit which generates a predetermined number of gradation reference signals which are referred to by said D/A conversion circuit; and a correction circuit which detects the total sum of the drive currents flowing in said self-luminous elements and controls said gradation reference circuit to produce a predetermined number of gradation reference signals whose levels are uniformly corrected according to the total sum, wherein said gradation reference circuit includes a voltage division circuit which comprises a plurality of resistor elements connected to output a predetermined number of gradation reference voltages whose voltage ratios to a reference power supply voltage differ from each other, as the predetermined number of gradation reference signals, respectively.

2. The display device according to claim 1, wherein said self-luminous elements are formed of organic electro-luminescence elements.

3. A display device comprising:

a plurality of self-luminous elements arrayed to form a display screen; and a driving circuit which causes drive currents to flow in said self-luminous elements according to pixel signals, said driving circuit being configured to restrict the drive currents flowing in said self-luminous elements upon increase in the total sum of the drive currents, wherein said driving circuit comprises, a D/A conversion circuit which digital-to-analog converts the pixel signals;

a gradation reference circuit which generates a predetermined number of gradation reference signals which are referred to by said D/A conversion circuit; and a correction circuit which detects the total sum of the drive currents flowing in said self-luminous elements and controls said gradation reference circuit to produce a predetermined number of gradation reference signals whose levels are uniformly corrected according to the total sum, wherein said gradation reference circuit includes a current mirror circuit which comprises a plurality of active current mirror elements connected to output a predetermined number of gradation reference currents whose current ratios to a reference power supply current differ from each other, as the predetermined number of gradation reference signals, respectively.

4. The display device according to claim 3, wherein said self-luminous elements are formed of organic electro-luminescence elements.

* * * * *